US005623113A

United States Patent [19]

Valembois

[11] Patent Number: 5,623,113

[45] Date of Patent: Apr. 22, 1997

[54] PYROTECHNIC DEVICE FOR LAUNCHING AT LEAST ONE PROJECTILE

[75] Inventor: Guy Valembois, Blagnac, France

[73] Assignee: Etienne Lacroix Tous Artifices S.A., France

[21] Appl. No.: 502,343

[22] Filed: Jul. 14, 1995

[30] Foreign Application Priority Data

Jul. 19, 1994 [FR] France ..... 94 08896

[51] Int. Cl.[6] ..... F41F 7/00; F42B 4/14; F42B 12/58

[52] U.S. Cl. ..... 89/1.817; 89/1.819; 89/1.701; 102/340; 102/345; 102/352; 102/360; 102/438; 102/439; 102/489; 244/137.4

[58] Field of Search ..... 89/1.817, 1.816, 89/1.818, 1.819, 1.8, 1.701, 1.34, 1.35, 1.51; 102/489, 438, 340, 342, 345, 351, 352, 357, 360, 439; 244/136, 137.4

[56] References Cited

U.S. PATENT DOCUMENTS

| | | | |
|---|---|---|---|
| 3,139,795 | 7/1964 | Altschuler | 89/1.818 |
| 3,253,511 | 5/1966 | Zwicky | 89/1.817 |
| 3,779,130 | 12/1973 | Schnabele | 89/1.701 |
| 4,012,985 | 3/1977 | Magnusson | 89/1.818 |
| 4,444,085 | 4/1984 | Dragonuk | 89/1.51 |
| 4,474,101 | 10/1984 | Boulard et al. | 89/1.817 |
| 4,930,731 | 6/1990 | Roy et al. | 89/1.817 |
| 4,934,241 | 6/1990 | Piesik | 89/1.817 |
| 5,052,270 | 10/1991 | Travor et al. | 89/1.51 |
| 5,076,134 | 12/1991 | Marshall et al. | 244/137.4 |
| 5,243,917 | 9/1993 | Komstadius | 102/489 |
| 5,287,810 | 2/1994 | Aumasson et al. | 102/489 |
| 5,333,528 | 8/1994 | Klestadt et al. | 89/1.818 |
| 5,370,032 | 12/1994 | Reuche et al. | 89/1.701 |

FOREIGN PATENT DOCUMENTS

| | | | |
|---|---|---|---|
| 2436363 | 9/1978 | France | F42B 12/62 |
| 2469690 | 11/1979 | France | F42B 4/24 |
| 2638920 | 8/1976 | Germany | F42B 12/70 |

*Primary Examiner*—Michael J. Carone
*Assistant Examiner*—Theresa M. Wesson
*Attorney, Agent, or Firm*—Blakely Sokoloff Taylor & Zafman

[57] ABSTRACT

A pyrotechnic device for launching at least one projectile includes, in a longitudinal launcher tube closed at the rear by a rear wall, a closure member expelled when subjected to a longitudinal force exceeding a predetermined threshold and retaining at least one projectile on opposite sides of which are a front chamber and a rear chamber in which an impulse cartridge builds up a gas pressure simultaneously. In this way a plurality of projectiles can be fired sequentially by means of a single impulse cartridge.

18 Claims, 3 Drawing Sheets

PYROTECHNIC DEVICE FOR LAUNCHING AT LEAST ONE PROJECTILE

BACKGROUND OF THE INVENTION

1. Field of the Invention

The present invention concerns a pyrotechnic device for launching at least one projectile, of the type including:

a longitudinal launcher tube having a rear end closed by a transverse rear wall and an open front end, a projectile housed in the tube and adapted to slide longitudinally inside it, towards the front, to be expelled from it via the front end of the tube, means for defining with the tube and the projectile a rear gas expansion chamber immediately to the rear of the projectile, and an impulse cartridge adapted on command to develop gas pressure in the rear chamber to cause the expulsion of the projectile via the front end of the tube.

2. Description of the Prior Art

Launcher devices of this type are well known in implementations in which the impulse cartridge is housed in or communicates as directly as possible with the rear chamber, being integrated into either the rear wall of the launcher tube or the rear of the projectile.

The concepts of front and rear are to be understood with reference to the predetermined direction of displacement of the projectile relative to the tube on firing.

The aforementioned previously known disposition of the igniter has a number of drawbacks which can occur separately or cumulatively depending on the type of launcher device.

One of these drawbacks is that it is difficult to produce a preloaded launcher device including the tube and the projectile housed in it but with no igniter, for safe handling and storage. This is because the subsequent fitting of the igniter entails either removing the projectile from the tube and then replacing it, which is a difficult operation and necessarily takes a relatively long time under conditions in which speed may be vital, or a special arrangement of the tube entailing further machining and assembly operations during its manufacture and consequently increasing the overall cost of the device as a whole.

Another drawback is that if the front end of the tube is fitted with a cap to prevent the projectile escaping from the tube during handling or storage and undesirable substances such as water or dust entering the tube, the user does not usually need to remove the cap before firing because the projectile itself expels the cap on entering into contact with it when it is fired, which absorbs some of the energy with which the projectile is expelled and can modify the ballistics of the projectile in an uncontrolled manner.

A further drawback is the great difficulty of disposing a plurality of longitudinally juxtaposed projectiles in the tube for successive firing in a given sequence. This requires a respective impulse cartridge immediately to the rear of each projectile with all the impulse cartridges connected to common control means establishing the required sequence. This is complex and costly.

An object of the present invention is to propose a new design of launcher device of the type indicated in the preamble in order to overcome at least some of the above drawbacks.

SUMMARY OF THE INVENTION

To this end, the launcher device of the invention, which is of the type indicated in the preamble, includes:

means for closing the front end of the tube, retained on the tube by retaining means allowing them to be expelled when they are subjected to a longitudinal force towards the front exceeding a predetermined threshold, and means for defining with the tube, the closure means and the projectile a front gas expansion chamber immediately in front of the projectile, and the impulse cartridge is adapted to develop said gas pressure simultaneously in the front and rear chambers to apply said force to the closure means and expel them prior to expulsion of the projectile.

Accordingly, as the gas pressure developed by the impulse cartridge builds up simultaneously in the front and rear chambers, with the closure means still in place the projectile does not move because it has exactly the same surface area at the front and at the rear and so is subjected to equal pressures at both ends. The pressure can therefore rise in the front and rear chambers until it reaches a value which, in the front chamber, applies to the closure means a longitudinal force towards the front exceeding the predetermined threshold for expulsion of the closure means; the opposite (front) side of which is exposed to the pressure of the atmosphere. As soon as the threshold is reached, the closure means are expelled. The projectile does not contribute to this expulsion in any way and as a result its ballistics are not affected. As soon as the closure means are expelled, the front chamber is at atmospheric pressure whereas the rear chamber is still at the gas pressure developed by the impulse cartridge, with the result that the projectile is subjected to a longitudinal expulsion force. The projectile is then expelled under conditions that can be predetermined and with no risk of interference with the closure means.

To ensure the simultaneous build up of gas pressure by the impulse cartridge in the front and rear chambers previously mentioned the impulse cartridge is advantageously disposed in or communicates with the front chamber and non-return fluid communication means are advantageously provided between the front and rear chambers, said communication being open in the direction from the front chamber to the rear chamber and closed in the direction from the rear chamber to the front chamber.

In a particularly simple implementation the non-return fluid communication means include a longitudinal passage between the projectile and the tube and a lip seal between the projectile and the tube in this passage; however, other arrangements can be adopted for this purpose without departing from the scope of the present invention.

Note that if the impulse cartridge is disposed in the front chamber in this way, it can easily be placed in the tube after the projectile, which greatly facilitates the manufacture and storage of launcher devices including the tube housing the projectile but with no igniter. The igniter can be mounted quickly and with no particular difficulty at the time of use.

To this end, in one particular embodiment of the invention the closure means comprise a cap retained by said retaining means and sealed to the tube, which allows the impulse cartridge to be integrated therein.

This cap, to which the gas pressure in the front chamber is applied directly, can be inert, i.e. it can have only a closure function. Alternatively, it can itself constitute a front projectile housed in the tube and adapted to slide longitudinally inside the tube, towards the front, to be expelled from the tube via its front end prior to expulsion of the first-mentioned projectile.

Alternatively, the closure means can comprise a cap, for example a cap that is inert in the sense explained above, retained by said retaining means and a front projectile housed in the tube, disposed longitudinally between the first-mentioned projectile and the cap and adapted to slide longitudinally inside the tube, towards the front, to be expelled from the tube via its front end, expelling the cap prior to expulsion of the first-mentioned projectile. In this case the gas pressure is applied to the cap through the intermediary of the front projectile, which is sealed to the tube.

In either case, the simultaneous and progressive build up in the gas pressure in the front and rear chambers first maintains the same pressure at both ends of the first-mentioned projectile; this continues to be the case until the cap comprising the front projectile or the combination of the front projectile and the cap, which is exposed to atmospheric pressure at the front end, is subjected by virtue of this gas pressure to a longitudinal force directed towards the front exceeding the predetermined threshold for ejection of the closure means. The front projectile forming the cap or the front projectile and the cap separate from it but pushed by it are expelled; this opens the front chamber to atmosphere whereas the rear chamber is still at the gas pressure which caused expulsion of the front projectile. As a result the first-mentioned projectile is then expelled.

The exit speeds of the projectiles are defined by the inherent ballistic characteristics of each projectile, namely:

their respective masses, their active transverse cross-section, i.e. their cross-section respectively exposed at the front and at the rear to the gas pressure or to atmospheric pressure, i.e. their caliber, the active travel of the projectiles in the tube, the pressure in the front and rear chambers corresponding to expulsion of the cap, the latter possibly constituting one of the projectiles, the respective volumes of the front and rear chambers, normally characterized by their length given that the launcher tube usually has a constant interior transverse cross-section.

It is therefore no particular problem to fire two projectiles successively from the same tube under predetermined projectile sequence and exit speed conditions.

To this end, alternatively or cumulatively, the means for defining the rear chamber include at least one rear projectile housed in the tube, disposed longitudinally between the first-mentioned projectile and the rear wall and adapted to slide longitudinally inside the tube, towards the front, to be expelled from the tube via its front end, means being provided for defining with the tube and this rear projectile, or each rear projectile, another rear gas expansion chamber immediately to the rear of the projectile, the impulse cartridge being adapted to develop said gas pressure simultaneously in the front and rear chambers and in said other rear chamber or each other rear chamber, to expel the rear projectile or the successive rear projectiles, after the first-mentioned projectile.

The person skilled in the art will readily understand how, when the gas pressure builds up simultaneously in the front chamber, the rear chamber and the other rear chamber or each other rear chamber, the cap is expelled as a front projectile or preceding a front projectile, followed by the first-mentioned projectile, followed by the rear projectile or each of the rear projectiles in succession, with respective speed and timing conditions determined by the previously mentioned inherent ballistic characteristics of each projectile.

If the impulse cartridge is disposed in or communicates with the front chamber, as in the preferred embodiment previously referred to, and non-return fluid communication means are provided between the front and rear chambers, said communication being open in the direction from the front chamber to the rear chamber and closed in the direction from the rear chamber to the front chamber, for simultaneous build up of the gas pressure in the other rear chamber or each other rear chamber, in comparison with the front chamber and the first-mentioned rear chamber, other non-return fluid communication means are advantageously provided between the first-mentioned rear chamber and said other rear chamber or between each other rear chamber and the immediately rearwardly adjacent other rear chamber, said communication being open in the direction from the first-mentioned rear chamber to said other rear chamber, or from each other rear chamber to the immediately rearwardly adjacent other rear chamber, and closed in the direction from said other rear chamber to the first-mentioned rear chamber, or from each other rear chamber to said immediately forwardly adjacent other rear chamber. A particularly simple and reliable implementation results if, like the first-mentioned non-return fluid communication means, said other non-return fluid communication means include a longitudinal passage between the rear projectile or each rear projectile and the tube and a lip seal between the rear projectile or each rear projectile and the tube in this passage, although this embodiment merely constitutes one non-limiting example.

The means for defining the rear chamber can equally well comprise only the rear wall of the launcher tube, with no rear projectile.

The inherent ballistic characteristics which control the speed of ejection of each projectile include the length of the gas expansion chamber immediately to the rear of the projectile, given a constant interior transverse cross-section of the tube. Accordingly, the means for respectively defining the front chamber, the rear chamber, said other rear chamber or each other rear chamber advantageously include a respective longitudinal spacer with apertures to allow the respective fluid communication, so that simply choosing spacers of appropriate length varies the inherent ballistic characteristics of the various projectiles and therefore the firing sequence and their exit speeds.

This can also be achieved in a predetermined way by providing a respective expulsion pyrotechnic charge in the rear chamber, said other rear chamber, one or more of the other rear chambers, said expulsion pyrotechnic charge being sensitive to the gaseous emission of the impulse cartridge to add its effects to those of said gas pressure, under the same conditions, on the projectile immediately in front of it and on any projectile or projectiles to its rear.

The person skilled in the art will readily understand that the launcher device of the invention has many and varied applications. The first-mentioned projectile, the front projectile or each rear projectile can be chosen from a group including military projectiles, fireworks projectiles, flare projectiles, test projectiles, these examples being in no way limiting on the invention.

Other features and advantages of a launcher device of the invention will emerge from the following description of three non-limiting embodiments of the invention and the appended drawings which form an integral part of the description.

DETAILED DESCRIPTION OF THE PREFERRED EMBODIMENTS

Figure 1:
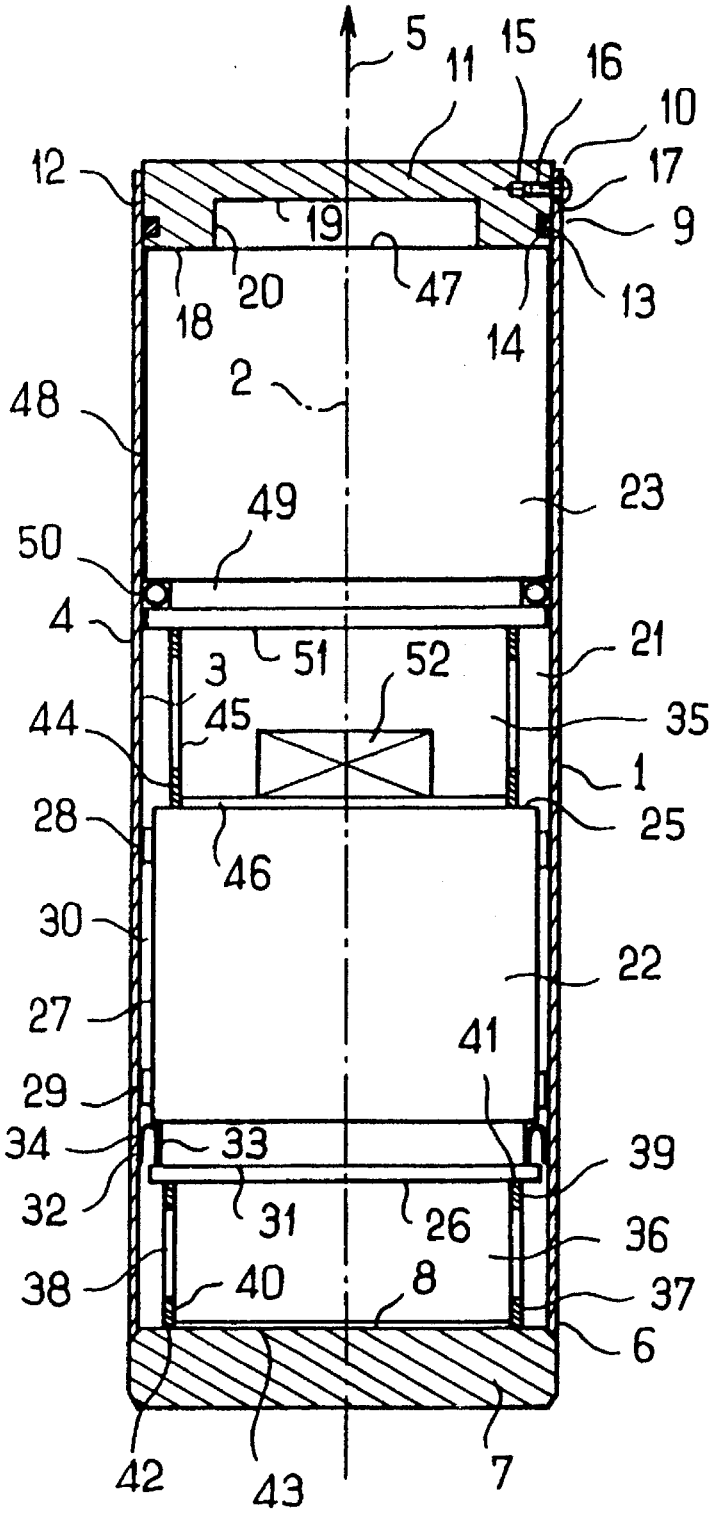
FIGS. 1 through 3 show three launcher devices of the invention in section on a longitudinal plane including a longitudinal axis of the launcher tube, namely a device with two projectiles, one of which is a front projectile, a device with two projectiles, one of which is a rear projectile, and a device with three projectiles, two of which are rear projectiles, in addition to the first-mentioned projectile.

The invention covers devices including a single projectile, that is to say the first-mentioned projectile, with no front projectile and no rear projectile, or the first-mentioned projectile, a front projectile and at least one rear projectile, it being understood that the number of rear projectiles can be chosen at will, and in particular can be greater than two, whether a front projectile is present or absent.

The three devices shown have many points in common and these will be described first, with reference of all of FIGS. 1 through 3, in which these parts are identified by the same reference numbers.

Each of the devices shown includes a longitudinal launcher tube 1 having a longitudinal axis 2 and delimited by a cylindrical inside face 3 which is concentric with this axis with a constant diameter determining the caliber of the launcher device. The tube 1 has a cylindrical outside face 4 which is also concentric with the axis 2 but with a diameter greater than that of the inside face 3. However, the shape of the outside face 4 is not critical in the context of the present invention.

The launcher tube 1 is sealed, in particular gas-tight.

Towards the rear (with reference to a predetermined longitudinal firing direction 5), the launcher tube 1 has a rear end 6 which is permanently closed and sealed by a transverse rear wall 7 which, in accordance with the invention and as shown here, can be solid and free of any impulse cartridge or initiation device of an impulse cartridge. In the example shown the rear wall 7 is a disk concentric with the axis 5 and having a plane transverse face 8 at the front, i.e. towards the interior of the launcher tube 1.

At the front (with reference to the direction 5), the launcher tube 1 has an open end 9 at which the inside face 3 and outside face 4 are joined together by a plane transverse annular rim 10 concentric with the axis 2.

The front end 9 is closed and sealed by a removable cap 11 in the form of a transverse circular member concentric with the axis 2. In the direction away from this axis, the cap 11 is delimited by a cylindrical outside face 12 the diameter of which is substantially equal to that of the inside face 3 of the tube 1 into which the cap 11 is inserted, at the front end 9 of the tube 1, under conditions such that relative longitudinal sliding guidance contact is established between the faces 12 and 3. An annular groove 13 in the face 12 concentric with the axis 2 houses an O-ring 14 which is thus retained on the cap 11 and brought into sealing contact with the inside face 3 of the tube 1 to seal the cap 11 to the tube, opposing only a known impediment to relative sliding of the cap 11 and the tube 1. At least one transverse radial blind hole 15 in the outside face 12 of the cap 11, in front of the groove 13, houses a radial pin 16 also passing through an appropriate bore 17 in the tube 1 in the immediate vicinity of the rim 10. There are preferably several pins 16 equi-angularly spaced around the axis 2 in respective blind holes 15 and bores 17 equi-angularly spaced around this axis. Operative in shear between the cap 11 and the tube 1, the pins retain the cap 11 on the tube 1 with no possibility of relative displacement until the cap 11 is subjected to a longitudinal force towards the front exceeding a predetermined threshold. They shear when the predetermined threshold is reached, to allow the cap 11 to be expelled towards the front by this force.

The front face of the cap 11, i.e. that on the outside of the launcher tube 1, has a shape that is immaterial with regard to the present invention. Towards the rear, i.e. towards the interior of the tube 1, it has:

in the part farthest from the axis 2, a transverse plane annular face 18 concentric with the axis 2 which merges with the outside face 12 in the direction away from the axis 2;

in the part nearest the axis 2, and intersecting the latter, a transverse plane face 19 concentric with the axis 2 which forms a disk offset towards the front relative to the face 18, with which the face 19 merges through an interior face 20 which is a cylinder concentric with the axis 2 and faces towards the latter.

When inserted in the tube 1 in this way, the cap 11 delimits with the tube 1 a gas-tight enclosure 21.

A projectile 22 is housed inside this enclosure 21, with no possibility of transverse relative movement but with the possibility of guided relative longitudinal sliding. The projectile 22 is the same in each of FIGS. 1 through 3 and can be the only projectile in the launcher device (this option is not shown but can easily be deduced by the person skilled in the art from the arrangements shown) or can be longitudinally juxtaposed to at least one other projectile also housed inside the sealed enclosure 21, namely a front projectile 23 with a different exterior conformation, as shown in FIG. 1, and/or at least one rear projectile 24 having a similar external conformation, as shown in FIGS. 2 and 3, which respectively show a single rear projectile and two rear projectiles, it being understood that the number of rear projectiles can be chosen at will and that the projectiles 22, 23, 24 can be of the same kind or of different kinds, chosen at will to obtain a required effect. In all cases the single projectile 22 or the combination of the projectile 22, the front projectile 23 and/or the rear projectile 24 (of which there may be more than one) is wedged inside the tube 1 between the face 8 of the rear wall 7 and the face 18 of the cap 11 in such a way as to prevent any relative longitudinal movement inside the tube 1 when the cap 11 is inserted in the latter and retained by the pins 16; likewise transverse relative movement is prevented.

In the non-limiting embodiment shown, the projectile 22 is delimited at the front and at the rear by respective circular transverse plane faces 25 and 26 which merge in the direction away from the axis 2 at a cylindrical outside face 27 which is concentric with the axis 2.

The outside face 27 has a smaller diameter than the inside face 3 of the launcher tube 1. Spacers attached to the outside face 27 of the projectile 22 and equi-angularly spaced around the axis 2 near the front face 25 (spacers 28) and near the rear face 26 (spacers 29) hold the projectile 22 coaxially in the launch tube 1 without opposing relative longitudinal sliding when the cap 11 has been expelled. The resulting gap 30 between the faces 27 and 3 in conjunction with the discontinuous nature of the spacers 28 and 29 in the circumferential direction allows gas to flow between the faces 27 and 3, in particular from the front towards the rear, i.e. from the immediate vicinity of the front face 25 towards the immediate vicinity of the face 26.

In a longitudinally localized area of the outside face 27, for example in the immediate vicinity of the rear face 26, an annular groove 31 concentric with the axis 2 is formed in the face 27 between the rear face 26 and the spacers 29. An annular seal 32 is nested in this groove 31 and is thereby attached to the projectile 22. This seal is concentric with the axis 2 and includes two lips defining a U-shape or a V-shape open towards the rear and closed towards the front when seen in section in any plane including the axis 2. This seal has a lip 33 housed in the groove 31 and thereby attached to the projectile 22 and a lip 34 bearing elastically against the inside face 3 of the launcher tube 1, without constituting any significant impediment to relative longitudinal sliding. This provides a seal between the seal 32 and the launcher tube 1 against flow of gas in the direction from the rear towards the front, i.e. from the rear face 26 towards the front face 25, via the gap 30. However, it does allow gas to flow through the gap 30 in the direction from the front towards the rear, i.e. from the front face 25 towards the rear face 26.

Other means could be provided for this purpose, either through the projectile 22 or between the inside face 3 and the outside face 4 of the launcher tube 1, given that, as will become clear later, the possibility for gas to flow from the face 25 of the projectile 22 to the face 26 of the latter is important only in the initial phase of firing, in which the projectile 22 is in the same, precisely defined longitudinal position in the launcher tube 1 as when the launcher device is loaded prior to use.

This provides, especially in this state of the launcher device, non-return communication between two sealed chambers 35, 36 delimited by the inside face 3 of the launcher tube 1 and, respectively, the front face 25 of the projectile 22, in the case of the chamber immediately in front of the latter, and the rear face 26 of the projectile 22, in the case of the chamber immediately to the rear of the latter.

The sealed chambers 35 and 36 are further delimited by means which differ according to the embodiment of the launcher device shown in FIGS. 1, 2 and 3, respectively, that will now be described in more detail in turn.

In the case of the FIG. 1 embodiment, the rear chamber 36 is delimited by the rear face 26 of the projectile 22, the inside face 3 of the launcher tube 1 and the face 8 of the rear wall 7 of the launcher tube 1. To this end a longitudinal spacer 37 is disposed longitudinally between the faces 26 and 8. It is a cylindrical tube concentric with the axis 2 and incorporates large apertures 38 to allow fluid communication between the chambers 35 and 36 via the gap 30. In the directions away from and towards the axis 2 the wall of the spacer 37 is respectively delimited by a cylindrical outside face 39 and a cylindrical inside face 40 concentric with the axis 2 and having a diameter less than the diameters of the inside face 3 of the launcher tube 1 and the outside face 27 of the projectile 22, respectively. At the top the two faces 39 and 40 are joined together by a transverse annular rim 41 concentric with the axis 2 and providing a flat rear seating for the face 26 of the projectile 22; towards the rear the two faces 39 and 40 are joined by another transverse annular rim 42 concentric with the axis 2 and which rests flat against the face 8 of the rear wall 7.

The spacer 37 can be held coaxial with the launcher tube 1 and the projectile 22 by various means, including attachment to the projectile 22 or to the rear wall 7, transverse wedging relative to the inside face 3 of the launcher tube 1, longitudinal nesting over or into an appropriate counterpart on the face 26 of the projectile 22, in a manner that is not shown but will be readily apparent to the person skilled in the art, or by longitudinal nesting over or in an appropriate counterpart on the face 8 of the rear wall 7, for example by longitudinal nesting over a localized protuberance 43 on the face 8 of the rear wall 7 as shown here, which represents a particularly simple form of the spacer 37 and a particularly easy way of inserting the latter in the launcher tube 1 before the projectile 22.

The front chamber 35 is delimited by the front face 25 of the projectile 22, the inside face 3 of the launcher tube 1 and the front projectile 23, to be more precise by a transverse plane face 51 at the rear of the latter.

A longitudinal spacer 44 is disposed longitudinally between the face 51 of the front projectile 23 and the face 25 of the projectile 22. The spacer 44 is in every respect similar to the spacer 37 and in particular, like the latter, has large apertures 45 which do not impede the flow of gas. The spacer 44 rests flat on both faces 25 and 51 by virtue of an outside diameter less than that of the latter. It is held coaxial with the projectiles 22 and 23 and with the launcher tube 1 by any of the means mentioned with reference to the spacer 37, for example by longitudinal nesting over a localized protuberance 46 on the face 25 of the projectile 22, which makes the spacer 44 equally easy to manufacture and equally easy to insert into the launcher tube 1 after the projectile 22 and before the projectile 23.

On the opposite longitudinal side to its face 51, i.e. towards the front, the projectile 23 is delimited by another transverse plane face 47 which, because of the appropriate longitudinal dimensions of the two projectiles 22 and 23 and the two spacers 37 and 44, compared to the longitudinal distance between the face 18 of the cap 11 and the face 8 of the rear wall 7, bears against the face 18 of the cap 11 when the latter occupies the position shown in FIG. 1, nested in the tube 1 and retained by the pins 16. In the direction away from the axis 2 the faces 51 and 47 are joined to a cylindrical outside face 48 of the projectile 23 which joins the faces 44 and 47 together and is concentric with the axis 2. Its diameter is substantially equal to that of the inside face 3 of the launcher tube 1, for guidance by relative longitudinal sliding. In a longitudinally localized manner, for example near the face 51, the face 48 incorporates an annular groove 49 concentric with the axis 2 and housing an O-ring 50 providing a seal between the outside face 48 of the projectile 23 and the inside face 3 of the launcher tube 1 without significantly impeding longitudinal relative sliding.

Note that the combination of the front chamber 35, the rear chamber 36 and the gap 30 between the projectile 22 and the launcher tube 1 constitutes a sealed volume by virtue of the presence of the seal 50, and that gas is able to flow from the chamber 35 to the chamber 36 via the gap 30 but cannot flow in the opposite direction.

This feature is used in this embodiment of the present invention for sequential expulsion of the projectile 23 and the projectile 22 by gas pressure generated on command in the front chamber 35 by an impulse cartridge 52 housed in the latter, as shown, or outside it but communicating with it (this is not shown but will be obvious to the person skilled in the art). The impulse cartridge 22 is advantageously located coaxially within the spacer 44 and is preferably attached to the projectile 22 (as shown), the projectile 23 or the spacer 44 by any means deemed suitable by the person skilled in the art.

The person skilled in the art will readily deduce from the above description how the launcher device shown in FIG. 1 works. The device is initially in the form shown in FIG. 1, i.e. with the cap 11 nested in the launcher tube 1 and retained by the pins 16, immobilizing longitudinally within the tube 1 the two projectiles 22 and 23 and the two spacers 37 and 44; actuation of the impulse cartridge 52, commanded from outside the launcher tube 1 by any appropriate means, e.g. by a wire connection through any of the components of the device or by a wireless connection, generates a considerable volume of gas in the front chamber 35 which propagates virtually instantaneously towards the chamber 36 via the gap 30, with the gas pressure building up at the same rate in the latter chamber, the seal 32 allowing gas to flow in this direction. The same pressure then acts on both ends of the projectile 22 but the combination of the projectile 23 and the cap 11, exposed to atmospheric pressure at the front, is subject to a thrust in the direction 5. As the gas pressure in the chambers 35 and 36 builds up, when this thrust exceeds the force to shear the pins 16 the latter shear and suddenly release the cap 11, which is expelled towards the front by the projectile 23 as the latter is itself expelled towards the front. The projectile 22 is then exposed to atmospheric pressure at the front whereas it is subject to the gas pressure at the rear because the seal 32 prevents the pressurized gas escaping from the chamber 36. Accordingly, an expulsion force towards the front is applied to the projectile 22 which is in turn expelled from the launcher tube 1.

The characteristics of this expulsion, including the sequence and the respective speeds of the projectiles 22 and 23, can be controlled by acting on the parameters mentioned above, in the simplest way by choosing the respective longitudinal dimensions of the spacers 37 and 44 determining the respective volumes of the rear chamber 36 and the front chamber 35.

Note that the successive expulsion of the projectiles 22 and 23 would occur under the same conditions if, in an embodiment of the invention that is not shown but that the person skilled in the art will readily deduce from the above description, the projectile 23 and the cap 11 were in one piece, i.e. if the projectile 23 itself constituted the cap 11 closing the launcher tube 1 and retained directly by the pins 16.

In another embodiment of the invention, also not shown but also easily deduced from the above description, there would be no projectile 23 in front of the projectile 22 which would then bear at the front, through the intermediary of the spacer 44 only, on the cap 11 inserted in the launcher tube 1 and retained by the pins 16; the front chamber 35 housing the impulse cartridge 52 would then be delimited by the face 25 of the projectile 22, the faces 18, 19, 20 of the cap 11 and the inside face 3 of the launcher tube 1 and the impulse cartridge could be fixed to the cap 11, either during manufacture of the launcher device or at the time of use. This embodiment would operate in exactly the same way as the device described with reference to FIG. 1 except that the cap 11 alone rather than the projectile 23 conjointly with the cap 11 would be expelled first.

Figure 2:
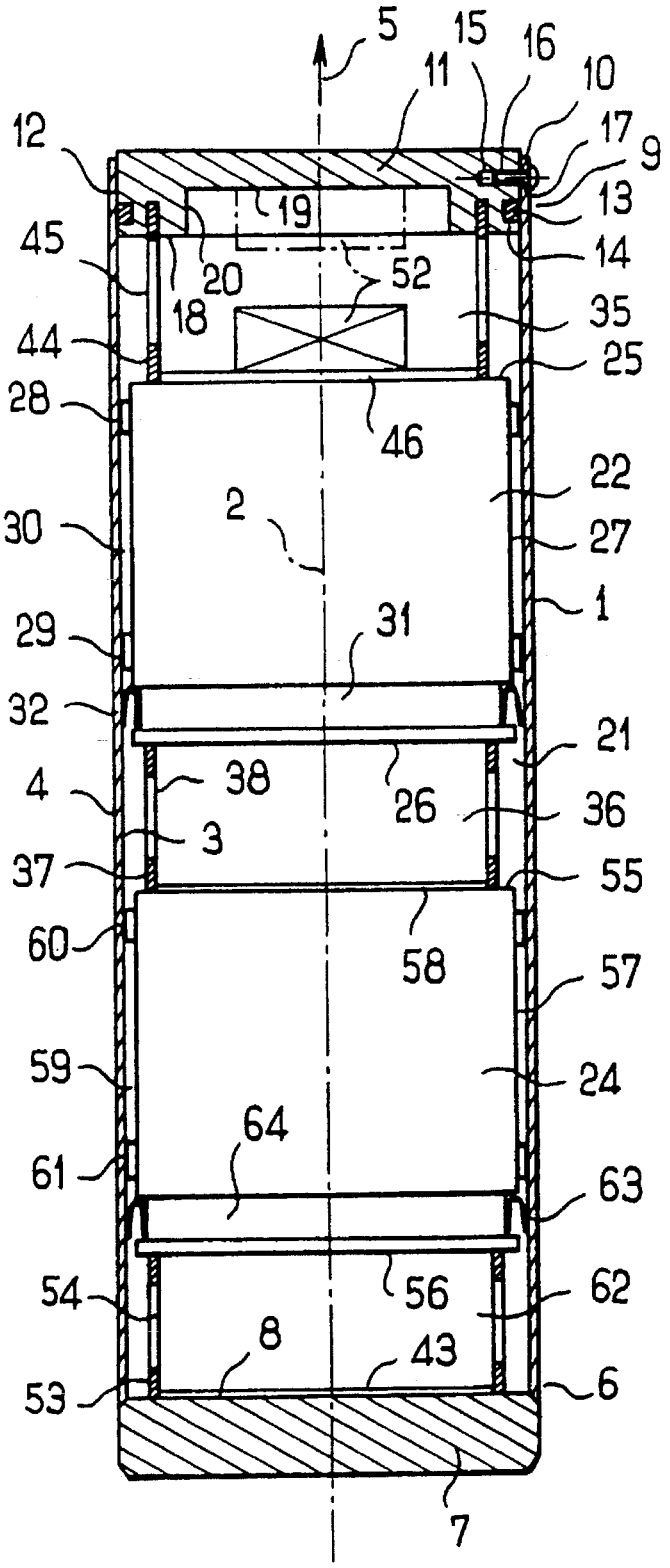

This embodiment can also be easily deduced from the following description of the launcher device shown in FIG. 2.

In this device, the chamber 35 immediately in front of the projectile 22 is exactly the same and is delimited by the face 25 of the projectile, the inside face 3 of the launcher tube 1 and the faces 18, 19, 20 of the cap 11 with the corresponding spacer 44, which is exactly the same, attached by localized insertion into the cap, for example, as shown. In this case the front chamber 35 also houses the impulse cartridge 52 which can be fixed to the projectile 22 or to the spacer 44, as shown in full line, or integrated into the cap 52, as shown in chain-dotted line, during manufacture of the launcher device or inserted in the cap 52, which is then adapted accordingly in a manner that will be readily apparent to the person skilled in the art, immediately prior to use of the device; it communicates via the gap 30 with the rear chamber 36 and gas can flow from the chamber 35 to the chamber 36 but not in the opposite direction because of the presence of the lip seal 32.

In this embodiment the chamber 36 is delimited by the face 26 of the projectile 22 and the inside face 3 of the tube 1. It is no longer delimited also by the face 8 of the rear wall 7 of the launcher tube 1 but instead by the rear projectile 24 on which the face 26 of the projectile 22 bears through the intermediary of the spacer 37 and which in turn bears on the face 8 of the rear wall 7 through a longitudinal spacer 53 in all respects similar to the spacer 37 and in particular having large apertures 54 similar in all respects to the large apertures 38 in the spacer 37, to allow unimpeded flow of gas.

The projectile 24 is itself in all respects similar to the projectile 22 as regards its external conformation and, in particular, it is delimited by a front face 55, a rear face 56 and an outside face 57 similar in all respects to the respective faces 25, 26, 27 of the projectile 22, except that the diameter of these faces can be slightly different than that of the faces 25, 26 and 27 and the longitudinal dimension of the projectile 24 between its faces 55 and 56 can be different than the dimension of the projectile 22 between its faces 25 and 26, the projectiles 22 and 24 being of the same kind or of different kinds.

To center the spacer 37 the front face 55 of the projectile 24 advantageously includes a protuberance 58 similar in all respects to the protuberance 46 on the front face 25 of the projectile 22. Its face 56 can be strictly plane, perpendicular to the axis 2, and rest flat on the spacer 54 in turn resting flat on the face 8 of the rear wall 7, on which it is centered by the protuberance 43.

Like the outside face 27 of the projectile 22, the outside face 57 of the projectile 24 and the inside face 3 of the launcher tube 1 define an annular gap 59. The face 57 is located transversely relative to said inside face 3 by spacers 30, 61 similar in all respects to the respective spacers 28 and 29 with the result that the projectile 24 is guided by longitudinal sliding inside the tube 1 whilst being immobilized transversely and the gap 59 allows gas to flow between the chamber 36 and a chamber formed to the rear of the projectile 24 by virtue of the spacer 53, this chamber being defined by the rear face 56 of the projectile 24, the face 8 of the rear wall 7 and the area of the inside face 3 of the tube 1 between these faces 56 and 58, by virtue of the presence of the spacer 53.

A lip seal 63 in all respects similar to the lip seal 32, oriented like the latter and retained like the latter in a transverse annular groove 64 in the outside face 57 of the projectile 24 between the face 56 and the spacers 61 nearest the face 56 allows gas to flow only from the chamber 36 to the chamber 62 and prevents any return flow from the chamber 62 to the chamber 36.

As mentioned with respect to the launcher device shown in FIG. 1, the means for allowing gas to flow from the chamber 35 to the chamber 36 and from the chamber 36 to the chamber 62 with flow prevented in the opposite direction could naturally be different without departing from the scope of the present invention.

The person skilled in the art will readily understand that the launcher device shown in FIG. 2 operates in the following manner, the device being initially in the state shown in which the projectiles 22 and 24 and the spacers 44, 37, 53 are immobilized longitudinally inside the sealed enclosure 21 by the cap 11 retained by the shear pins 16.

When the impulse cartridge 52 is actuated, it generates gas which propagates from the chamber 35 towards the chamber 36 and from the latter towards the chamber 62 with the result that the interior of the enclosure 21 is at a uniform pressure and the projectiles 22 and 24 are exposed to the same pressure at both ends and are therefore not subjected to any longitudinal force tending to expel them.

A longitudinal force is applied to the cap 11, however, and when the gas pressure in the enclosure 21 reaches a value such that this force exceeds the predetermined threshold at which the pins 16 shear, the latter shear and release the cap 11 which is expelled longitudinally towards the front.

The chamber 35 is therefore at atmospheric pressure, and therefore likewise the face 25 of the projectile 22, whereas the face 26 of the latter is still exposed to the aforementioned gas pressure, the gas being unable to escape towards the front because of the presence of the seal 32.

The chambers 36 and 62 remain at the same pressure with the result that the projectile 24 is not subjected to any longitudinal expulsion force. The projectile 22 is subject to a longitudinal expulsion force, however, and is expelled.

The chamber 36 is then open to atmosphere, with the result that the face 55 of the projectile 24 is exposed to atmospheric pressure although the aforementioned gas pressure is still present in the chamber 62, the gas being unable to escape because of the presence and the shape of the seal 63.

As a result a longitudinal expulsion force is applied to the projectile 24 which is fired in its turn.

The parameters of this expulsion are those mentioned in the preamble. In particular, the conditions for successive firing of the projectiles 22 and 24 can be modified by choosing appropriate longitudinal dimensions of the spacers 37, 44, 53 determining the respective volumes of the chambers 36, 35, 62.

If a projectile similar to the projectile 23 were disposed between the projectile 22 and the cap 11, as described with reference to FIG. 1, or formed the cap 11, it would naturally be expelled simultaneously with the cap 11 in the sequence just described.

Figure 3:
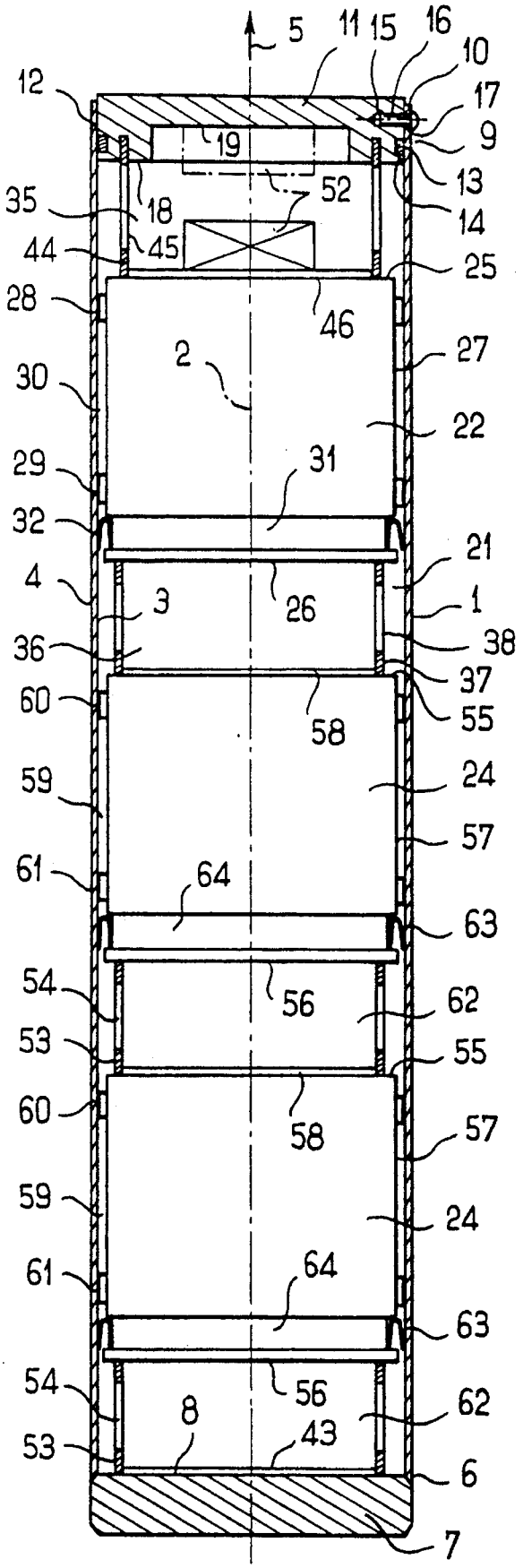

The person skilled in the art will readily understand that the number of projectiles that can be fired in this way in controlled succession from the same launcher tube 1 can be chosen at will and, by way of non-limiting illustrative example of this possibility, FIG. 3 shows a launcher device in all respects similar to that of FIG. 2 except that a second projectile 24 similar to the aforementioned projectile 24 with respect to its external conformation, of the same kind or of a different kind, is disposed between the spacer 53 immediately to the rear of the latter and the face 8 of the rear wall 7, against which this other projectile 24 bears through the intermediary of another spacer 53, with large apertures 54, defining with the launcher 1 and the rear wall 7 another sealed chamber 62. The seal 63 on the other projectile 24 keeps this other chamber 62 at the same gas pressure as the first-mentioned chamber 62 and the chambers 36 and 35 as the gas pressure supplied by the impulse cartridge 52 builds up and prevents this other chamber 62 losing this gas pressure and therefore causes application to the other projectile 24 of a longitudinal expulsion force towards the front when its front face 55 is exposed to atmospheric pressure, after successive expulsion of the cap 11, a projectile 23, if any, the projectile 22 and the first-mentioned projectile 24.

Note that in each of the three embodiments of the invention just described the gases generated by the impulse cartridge 52 alone expel all the projectiles in succession. In a different embodiment, there could be superposed on their action, for this purpose, the action of an expulsion pyrotechnic charge 65 in the chamber 36 (FIGS. 1 to 3) and/or in the chamber 62 (FIG. 2) or in one or more of the chambers 62 (FIG. 3). A few non-limiting examples of the disposition of this pyrotechnic charge are shown in chain-dotted outline. The pyrotechnic charge could be of a type sensitive to the gaseous emission of the impulse cartridge 52, for example to the temperature of the gases emitted by the latter or to the gas pressure corresponding to the force expelling the cap 11, suitably time-delayed to add its effects to those of the pressure of the gases generated by the impulse cartridge 52 on the projectile 22 or 24 immediately in front of it when it is expelled and on the projectile or projectiles 24 to its rear, if any, to expel them subsequently.

The person skilled in the art will readily understand that the three launcher devices shown are merely non-limiting examples of embodiments of the invention and that numerous variants thereof can be arrived at without departing from the scope of the invention.

There is claimed:

1. Pyrotechnic device for launching at least one projectile, including:

a longitudinal launcher tube having a rear end closed by a transverse rear wall and an open front end, a projectile housed in said tube and adapted to slide longitudinally inside the latter, towards the front, to be expelled from said tube via its front end, means for defining with said tube and said projectile, immediately to the rear of the latter, a rear gas expansion chamber, an impulse cartridge adapted to develop on command gas pressure in said rear chamber to expel said projectile through said front end of said tube, means for closing said front end of said tube retained on said tube by retaining means allowing expulsion of said closing means when said closing means are subjected to a longitudinal force directed towards the front and exceeding a predetermined threshold, and means for defining with said tube, said closure means and said projectile a front gas expansion chamber immediately in front of said projectile, and wherein said impulse cartridge is adapted to develop said gas pressure simultaneously in said front chamber and said rear chamber to apply said force to said closure means and to expel said closing means before expelling said projectile.

2. Device according to claim 1 wherein said impulse cartridge is disposed in or communicates with said front chamber and non-return fluid communication means are provided between said front chamber and said rear chamber, said communication being open in the direction from said front chamber to said rear chamber and closed in the direction from said rear chamber to said front chamber.

3. Device according to claim 2 wherein said non-return fluid communication means include a longitudinal passage between said projectile and said tube and a lip seal between said projectile and said tube in said passage.

4. Device according to claim 3 wherein the respective means for defining said front chamber, said rear chamber include respective longitudinal spacers apertured to allow the respective fluid communication.

5. Device according to claim 1 wherein said closure means comprise a cap retained by said retaining means and sealed to said tube.

6. Device according to claim 5 wherein said impulse cartridge is integrated into said cap.

7. Device according to claim 5 wherein said cap constitutes a front projectile housed in said tube and adapted to slide longitudinally inside said tube, towards the front, to be expelled from said tube via its front end before expulsion of the first-mentioned projectile.

8. Device according to claim 1 wherein said closure means comprise a cap retained by said retaining means and a front projectile housed in said tube, disposed longitudinally between the first-mentioned projectile and said cap sealed to said tube and adapted to slide longitudinally inside said tube towards the front, to be expelled from said tube via its front end with said cap expelled prior to expulsion of said first-mentioned projectile.

9. Device according to claim 7 or 8 wherein said first mentioned projectile, and said front projectile is at least one of a military projectile, a fireworks projectile, a flare projectile and a test projectile.

10. Device according to claim 1 wherein said means for defining said rear chamber include said rear wall of said launcher tube.

11. Device according to claim 1 wherein said means for defining said rear chamber include at least one rear projectile housed in said tube, disposed longitudinally between the first-mentioned projectile and said rear wall and adapted to slide longitudinally inside said tube, towards the front, to be expelled from said tube via its front end, means are provided for defining with said tube and said rear projectile or each rear projectile another rear gas expansion chamber immediately to the rear of the latter, and said impulse cartridge is adapted to build up said gas pressure simultaneously in said front and rear chambers and in said other rear chamber or in each other rear chamber, to expel said rear projectile or said rear projectiles in succession after said first-mentioned projectile.

12. Device according to claim 11 wherein said impulse cartridge is disposed in or communicates with said front chamber and non-return fluid communication means are provided between said front chamber and said rear chamber, said communication being open in the direction from said front chamber to said rear chamber and closed in the direction from said rear chamber to said front chamber and further non-return fluid communication means are provided between said first-mentioned rear chamber and said other rear chamber or each other rear chamber and said other rear chamber immediately rearwardly adjacent thereto, said communication being open in the direction from said first-mentioned rear chamber to said other rear chamber or from each other rear chamber to said other rear chamber immediately rearwardly adjacent thereto, and closed in the direction from said other rear chamber to said first-mentioned rear chamber or each other rear chamber to said other rear chamber immediately forwardly adjacent thereto.

13. Device according to claim 12 wherein said other non-return fluid communication means include a longitudinal passage between said rear projectile or each rear projectile and said tube and a lip seal disposed in said passage between said rear projectile or each rear projectile and said tube.

14. Device according to claim 13 wherein the respective means for defining said front chamber, said rear chamber, said other rear chamber, and each other rear chamber include respective longitudinal spacers apertured to allow the respective fluid communication.

15. Device according to claim 11 further including a respective expulsion pyrotechnic charge in said rear chamber, said other rear chamber, one or more of said other rear chambers, said expulsion pyrotechnic charge being sensitive to the gaseous emission of the impulse cartridge to add its effects to those of said gas pressure on the projectile immediately in front of it and on the projectile or projectiles to its rear.

16. Device according to claim 11 wherein said first mentioned projectile, and said at least one rear projectile is at least one of a military projectile, a fireworks projectile, a flare projectile and a test projectile.

17. Device according to claim 1 further including an expulsion pyrotechnic charge in said rear chamber, said expulsion pyrotechnic charge being sensitive to the gaseous emission of the impulse cartridge to add its effects to those of said gas pressure on the projectile immediately in front of it.

18. Device according to claim 1 wherein said projectile is at least one of a military projectile, a fireworks projectile, a flare projectile and a test projectile.

* * * * *